US011473548B2

(12) United States Patent
Kachelhoffer et al.

(10) Patent No.: US 11,473,548 B2
(45) Date of Patent: Oct. 18, 2022

(54) ELECTRICAL LOAD RESISTANCE

(71) Applicant: Eberspächer catem GmbH & Co. KG, Herxheim (DE)

(72) Inventors: Patrick Kachelhoffer, Seebach (FR); Kurt Walz, Hagenbach (DE); Christof Lausser, Bad Bergzabern (DE); Markus Stollhof, Bornheim (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 135 days.

(21) Appl. No.: 16/996,006

(22) Filed: Aug. 18, 2020

(65) Prior Publication Data

US 2021/0054819 A1 Feb. 25, 2021

(30) Foreign Application Priority Data

Aug. 20, 2019 (DE) ..... 102019212443.7

(51) Int. Cl.
*F02N 19/02* (2010.01)
*H05B 1/02* (2006.01)
*H05B 3/20* (2006.01)

(52) U.S. Cl.
CPC ..... *F02N 19/02* (2013.01); *H05B 1/0236* (2013.01); *H05B 3/20* (2013.01); *F02N 2200/023* (2013.01); *H05B 2203/02* (2013.01)

(58) Field of Classification Search
CPC . F02N 19/02; F02N 2200/023; H05B 1/0236; H05B 3/20; H05B 2203/02;
(Continued)

(56) References Cited

U.S. PATENT DOCUMENTS 4,626,666 A 12/1986 Maeda et al.
5,262,619 A 11/1993 Karner
(Continued)

FOREIGN PATENT DOCUMENTS

DE 3440166 5/1985
DE 10 2012 204 106 9/2013
(Continued)

*Primary Examiner* — Jacob M Amick
*Assistant Examiner* — Charles J Brauch
(74) *Attorney, Agent, or Firm* — Boyle Fredrickson S.C.

(57) ABSTRACT

An electrical load resistance includes a housing having at least one U-shaped receiving pocket, in which at least one PTC heating element is accommodated. The PTC heating element includes at least one PTC element and at least one contact plate electrically conductively connected to the PTC element for energizing the PTC element. The contact plate has a terminal lug for plug contacting the PTC element, and the PTC heating element abuts at least on opposite main side surfaces of the receiving pocket in a heat-conducting manner and projects beyond the terminal lug of the receiving pocket. The housing of the electrical load resistance is closed, and thus has no inlet or outlet openings for a medium to be heated. Also provided is a device with an electrical load resistance for reducing the starting time of an internal combustion engine, a method for reducing the starting time of an internal combustion engine, and a use of a PTC heating device as an electrical load resistance for reducing the starting time of an internal combustion engine.

14 Claims, 4 Drawing Sheets

(58) Field of Classification Search
CPC ..... H05B 3/04; H05B 3/24; H05B 2203/023; H05B 3/50; H05B 3/10; F02D 2041/026; F02D 2250/24; F02D 41/068; F24H 2250/04; F24H 3/002; F24H 3/0429; F24H 9/1863; F24H 9/1872
See application file for complete search history.

(56) References Cited

U.S. PATENT DOCUMENTS

| | | | | |
|---|---|---|---|---|
| 8,946,599 | B2 | 2/2015 | Niederer et al. | |
| 2015/0013632 | A1 * | 1/2015 | Carlens | F02N 19/10 392/479 |
| 2018/0142630 | A1 | 5/2018 | Boggs | |

FOREIGN PATENT DOCUMENTS

| | | | | |
|---|---|---|---|---|
| DE | 10 2013 212 205 | | 12/2014 | |
| DE | 20 2018 101 634 | | 4/2018 | |
| EP | 1 457 652 | | 9/2004 | |
| EP | 1 872 986 | | 1/2008 | |
| EP | 1872986 | A1 * | 1/2008 | B60H 1/2221 |
| EP | 1 921 896 | | 5/2008 | |
| EP | 2440004 | | 4/2012 | |
| WO | WO-2007006393 | A1 * | 1/2007 | F01N 3/2066 |
| WO | WO-2008122362 | A1 * | 10/2008 | F24H 3/0405 |

* cited by examiner

ELECTRICAL LOAD RESISTANCE

BACKGROUND OF THE INVENTION

1. Field of the Invention

The present invention relates to an electrical load resistance.

2. Background of the Invention

It is known that the parts of an internal combustion engine are subject to thermal expansion. Usually, the parts are therefore manufactured such that they have the optimum fit at the operating temperature of the combustion engine. For example, the piston only becomes absolutely cylindrical at operating temperature and can rest on its entire surface in the cylinder. In a cold engine, the parts accordingly do not fit optimally into each other and wear is higher than at operating temperature. Furthermore, in a cold engine, the fuel condenses on the cold cylinder wall. In order to compensate for this, more fuel must be added, which increases consumption and pollutant emissions. The engine oil is also too viscous when it is cold to lubricate well. The catalytic converter only works efficiently at a certain minimum temperature of the exhaust gases.

SUMMARY

In the light of this technical problem area, the present invention proposes an electrical load resistance having a closed housing comprising at least one U-shaped receiving pocket in which a PTC heating element is accommodated. The PTC heating element has at least one PTC element and at least one contact plate electrically conductively connected to the PTC element for energizing the PTC element. The housing usually forms several U-shaped receiving pockets, wherein one PTC heating element is usually provided in each receiving pocket. Generally, the PTC heating element has several PTC elements that are energized via the contact plate. The contact plate has a terminal lug for plug connection of the PTC element(s). The PTC heating element abuts heat-conductively at least on opposite main surfaces of the receiving pocket, wherein the terminal lug of the contact plate projects above the receiving pocket.

A closed housing is, in particular, a housing that has no openings for the inlet or outlet of a medium. Usually, the closed housing only has an insertion opening for inserting the PTC heating elements into the housing, which is usually closed by a housing cover, and a through-hole through which at least one electrical cable for connecting the PTC heating element(s) is sealingly passed. The heat generated by the PTC heating elements is therefore not transferred to a medium circulating through the housing, but is absorbed by the housing, which is usually made of a material with good thermal conductivity. Generally, the housing completely encapsulates the PTC heating elements. The housing can be made of metal, especially aluminum, or ceramic, for example. The receiving pockets can extend into a chamber that can be filled with a heat-storing filling such as cement or sand. The housing can, because it is closed, absorb in an improved manner a large amount of heat in a short time.

According to a further development of the present invention, external surfaces of the housing form the only boundary surfaces of the electrical load resistance to dissipate heat. The boundary surfaces are to be understood in particular as the outer walls of the housing, but also surfaces formed by partition walls running inside the housing. Thus, according to this further development, heat-emitting surfaces of the housing are exclusively provided on the outside of the housing. Consequently, according to this further development, a heat-storing filling incorporated into the housing is dispensed with. Usually, the heat generated by PTC heating elements is introduced into the housing by heat-conducting abutment against an inner surface of an outer wall of the housing and radiated via the outer surface of the outer wall of the housing by thermal radiation. The thickness of the outer wall of the housing may vary and is usually selected so that the housing has sufficient mass to absorb a heat quantity of 20 to 30 kJ, more typically 23 to 27 kJ and still more typically 25 kJ, within 20 s. The heat generated by the PTC heating elements according to this development is radiated directly through the housing to the surroundings, which improves the heat absorption or heat dissipation capacity. Large quantities of heat can thus be generated and absorbed in a short time without the electrical load resistance itself suffering damage from overheating or causing damage to other parts.

According to another further development of the present invention, the housing is configured as a heat sink. In this case, the receiving pocket is exposed as a cooling fin on an outer side of the housing. The outer sides of the opposite main side surfaces of the receiving pocket are usually completely or at least largely exposed to the ambient atmosphere. Several receiving pockets nay be provided in a row one behind the other so that the cross-section of the housing has a substantially sinusoidal outer contour in the area of the receiving pockets. Generally, the housing forms an indentation between two receiving pockets in which an outer wall of the housing extends towards the interior of the housing. The indentation is usually U-shaped and usually extends anti-parallel to the receiving pocket(s). The length of the main extension direction usually corresponds to that of the receiving pockets. Several indentations may also be provided between two cooling fins.

By configuring the housing as a heat sink and especially the receiving pockets as cooling fins, the heat-emitting surface of the electrical load resistance can be increased. Possible damage due to overheating can thus be prevented and the heat absorption and heat dissipation capacity is further improved. In addition, the known self-regulating property of the PTC elements helps to prevent overheating.

According to another further development of the present invention, the electrical load resistance comprises a housing cover which is usually fluid-tightly connected to the housing and has at least one web to secure the plug contact of the PTC element. The web may consist of a rubber-elastic material or at least have a region made of such a rubber-elastic material. Such a rubber-elastic material can be an elastomer, for example. Like a column, the web can protrude from a housing cover base. Generally, the number of webs and the number of receiving pockets are identical so that by mounting the housing cover on the housing, a secondary interlock for the plug contact of the PTC elements is realized. The housing cover is usually mounted on the side of the housing opposite the receiving pockets. The web is usually provided in extension of the receiving pocket, wherein one tip of the web abuts and/or surrounds a plug element contacting the terminal lug. In particular, the web also holds the PTC heating element in the opening direction of the receiving pocket with a form-fit and/or frictional connection in the receiving pocket. The housing cover may be mounted on the housing such that the web exerts a compressive force on the plug element in the direction of the receiving pocket. Elastic deformation of the web can also adjust any settling amounts during operation of the load resistance, provided that the web interacts with the plug element under elastic pretension. The web may have a recess at its tip in which the plug element abuts. The housing cover usually has a plate-shaped base from which the webs protrude at right angles. The housing cover may include the plate-shaped base and the webs. When installed, the web usually bridges an intermediate space or gap and keeps it partially free. This intermediate space or gap extends between the outer, usually the free end of the web and its mounting end.

In this way, irrespective of the installation situation of the electrical load resistance, it can be ensured that the PTC heating elements do not fall out of the receiving pockets or become detached from them through vibration, but always have a heat-conducting contact with their main side surfaces and that the plug contacts are secured secondarily.

According to another further development of the present invention, a cable for the connection of the PTC heating element is sealingly led through the housing. In this through-hole of the housing, a sealing element is usually provided which completely encloses the cable. The through-hole for the cable is usually fluid-tightly sealed, so that—since the housing is closed—no exchange between a medium outside the housing and the interior of the housing takes place. The housing cover is also usually mounted fluid-tight on the housing. The inside of the housing is therefore usually atmospherically separated from the environment of the housing. Usually, the cable comprises several wires, whereby one wire at each end is connected to a plug element which contacts the terminal lug and abuts in the recess of the web. The cores of the cable can be led separately through the through-hole and can each be provided with a single core seal in the area of the through-hole. A sealing element is provided in the through-hole by which the cable is led through and compensates to a certain extent for a tensile force acting on the cable from outside the housing. The sealing element usually abuts tightly on the outside of the housing around the opening. Generally, the housing thus complies with the IP6K9K and IP67 protection standards of ISO standard 20653:2013.

Thus, the electrical load resistance can be used in the most diverse installation situations. The complete encapsulation of the PTC heating elements by the housing allows them to be used, for example, at an exposed location in the engine compartment or in the wheel arch of a vehicle.

According to a further development of the present invention, the PTC element is electrically conductively connected to the housing, wherein the housing forms a ground potential for the PTC element. According to this development of the present invention, only a contact plate forming a terminal lug is provided on one side of the PTC element and electrically insulated from the housing in the receiving pocket. On the opposite side of the PTC element, according to this further development, it abuts electrically conductively against the housing in the receiving pocket. The opposite sides are generally the main side surfaces of the PTC element. According to this further development, the housing is part of the power circuit. Usually, the housing forms a ground terminal inside which is generally electrically connected to the vehicle body when the electrical load resistance in a motor vehicle is used.

This reduces the amount of cabling required to connect the PTC heating elements and the components needed for the PTC heating elements.

According to another further development of the present invention, the housing is made of a material having a specific heat capacity of at least 800 J/(K·Kg) at a material temperature of 20° C., wherein the housing has a weight of at least 500 g. Usually, the housing is made of metal, in particular aluminum, or of ceramic. Very preferably, the housing is made of a cast aluminum alloy, usually by die-casting. More typically, the housing is made of a material having a specific heat capacity of at least 890 J/(K·Kg) at a material temperature of 20° C., wherein the housing has a weight of at least 550 g. The thickness of the housing walls is generally such that a surface temperature on the outside of the housing does not exceed 140° C. The electrical load resistance according to the present invention usually has an electrical power of at least 1000 W, preferably at least 1250 W.

Thus, it can be guaranteed that the electrical load resistance can generate a heat quantity of 20 to 30 kJ, more typically 23 to 27 kJ, and most typically 25 kJ within a time of 10 to 30 s, preferably 15 to 25 s and very preferably 20 s and store it in the housing.

In a secondary aspect, the present invention relates to a device for reducing the starting time of an internal combustion engine. The device comprises an electrical load resistance with at least one PTC heating element accommodated in a housing The electrical load resistance is connected to a generator driven by the internal combustion engine and the housing is mounted on a vehicle comprising the internal combustion engine such that the heat generated by the device is exclusively and directly dissipated to the environment or stored in the housing. The electrical load resistance of this device may be the electrical load resistance according to the invention, but is not limited thereto. The device is rather characterized by the objective arrangement of its components. Accordingly, the electrical load resistance of the device is arranged outside a forcedly guided medium flow, thus, it is not detected by the forcedly guided medium flow or passed around it. The exclusive and direct dissipation of heat to the environment is therefore to be understood in particular as heat dissipation by thermal radiation and, if necessary, natural convection, which does not require forced cooling. The device is generally located in the engine compartment of a vehicle equipped with an internal combustion engine. An electric auxiliary heater for heating air flowing into a passenger compartment of the vehicle is usually also provided there. The electrical auxiliary heater is to be distinguished from the electrical load resistance of the device, since the electrical auxiliary heater is passed through by a liquid medium which heats the air flowing into the passenger compartment, or is directly passed around by the air flowing into the passenger compartment.

Since the combustion engine drives the generator and the electrical load resistance of the device is connected to the generator, the combustion engine is loaded more by the electrical load resistance and thus reaches its operating temperature faster, i.e. the starting time of the combustion engine is reduced. The electrical load resistance of the device may be located at an exposed position in the engine compartment or in the wheel arch of the vehicle. It releases its thermal energy to the environment. The energy is not used to heat the interior of the vehicle and/or to heat a technical component whose efficiency is favored at elevated temperatures.

In a method aspect, the present invention relates to a method for reducing the starting time of an internal combustion engine, wherein the temperature of the internal combustion engine is measured and a load resistance connected to a generator driven by the internal combustion engine is operated until the measured temperature of the internal combustion engine reaches a predetermined temperature. The predetermined temperature is usually the operating temperature of the combustion engine, in particular approximately 90° C. After the engine has reached its operating temperature, the load resistance is usually disconnected from the electrical energy source (the generator), generally at least until the combustion engine is restarted. Usually, the measured temperature is transmitted to a control unit, which controls an actuator or a switch for coupling or decoupling the load resistance with the generator depending on the measured temperature. The variable for switching off the load resistance is therefore the measured temperature of the combustion engine, wherein the load resistance is switched off as soon as the measured temperature reaches the predetermined temperature, which generally corresponds to the operating temperature of the combustion engine.

The method according to the invention allows the targeted reduction of the starting time of an internal combustion engine by connecting an additional electrical load to the generator, wherein the temperature of the internal combustion engine serves as the variable.

According to a further development of the method according to the invention, the load resistance is operated cyclically, wherein one cycle includes a power phase and a rest phase. The power phase is understood to be a time interval in which the load resistance converts electrical energy produced by the generator into heat. The rest phase, on the other hand, is a time interval in which the generator is not loaded with the load resistance; i.e. in the rest phase the electrical load resistance does not generate any heat Due to this cyclic operation, a high amount of heat can be produced in a short time during the power phase and, if necessary, temporarily stored in the housing of the load resistance, which is then radiated to the environment during the rest phase. The duration of the rest phase is to be selected accordingly such that sufficient cooling of the load resistance is ensured and the heat generated in the subsequent power phase can be temporarily stored again by the load resistance, in particular by its housing, in order to be finally radiated to the surroundings again in the rest phase.

More typically, a cycle consisting of a power phase and a rest phase lasts between 30 and 120 s, still more typically between 50 and 110 s and most typically between 90 and 105 s. The rest phase is usually 2 to 5 times, typically 3 to 4 times longer than the power phase.

Thus, the load resistance can be operated at high power in the power phases, allowing the combustion engine to be loaded with a sufficient load to reduce the starting time.

In a further secondary aspect, the present invention relates to the use of a PTC heating device that may be known per se in a vehicle with an internal combustion engine as an electrical load resistance for reducing the starting time of the internal combustion engine, wherein the use is effected without the heat generated by the PTC heating device being supplied for use within the vehicle. When the PTC heating device is used in this way, the heat generated by the PTC heating device is exclusively and directly dissipated to the environment or stored in a housing of the PTC heating device. According to this use, the PTC heating device is not used in the usual way to heat air flowing into a passenger compartment of the vehicle or other components within the vehicle. The heat generated by the PTC heating device is not used in this application. It is mainly radiated to the surrounding atmosphere by thermal radiation and is usually dissipated from it in an undirected manner.

BRIEF DESCRIPTION OF THE DRAWINGS

Further details and advantages of the present invention can be derived from the following description of a preferred embodiment in connection with the drawing. Therein.

DETAILED DESCRIPTION

Figure 1:
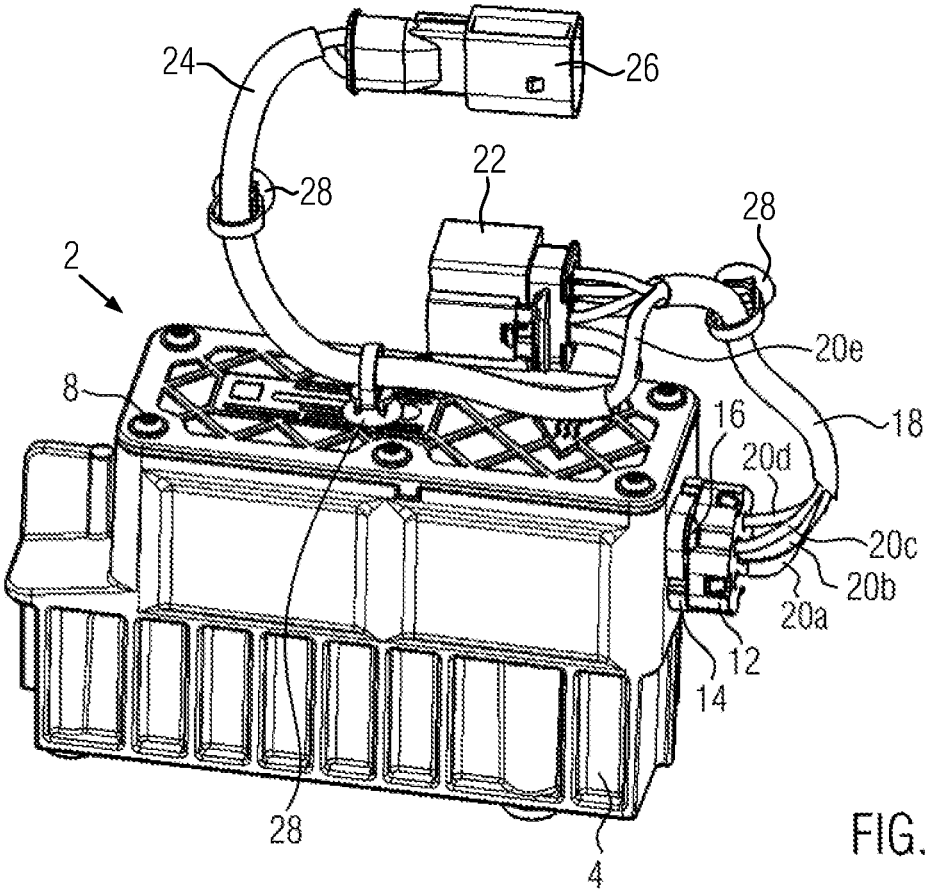
FIG. 1 shows a perspective side view of an electrical load resistance of the embodiment.

The electrical load resistance 2 shown in FIG. 1 has an essentially cuboid housing 4 made of aluminum. The housing 4 is covered with a plastic housing cover 6 which closes a connection chamber. The housing cover 6 is screwed to the housing 4 by means of screws 8. A through-hole 10 of the housing 4 (see FIG. 4) is the only opening of the housing 4 to the connection chamber apart from the opening of the housing 4 closed by the housing cover 6. A sealant 12 is provided in the through-hole 10. The sealant 12 abuts the outside of the housing 4 with a seal 14 around the through-hole and is sealed against it by means of screws 16. An electrical connecting cable 18 is led through the sealant 12 in a sealing manner. The electrical connecting cable 18 comprises several strands 20 which are contacted with their end outside the housing by a plug 22. A second end 24 of the connecting cable is contacted with a separate plug 26. The electrical load resistance 2 has fasteners 28 for fixing the cable 18, wherein one of the fasteners 28 is provided on the housing cover.

Figure 2:
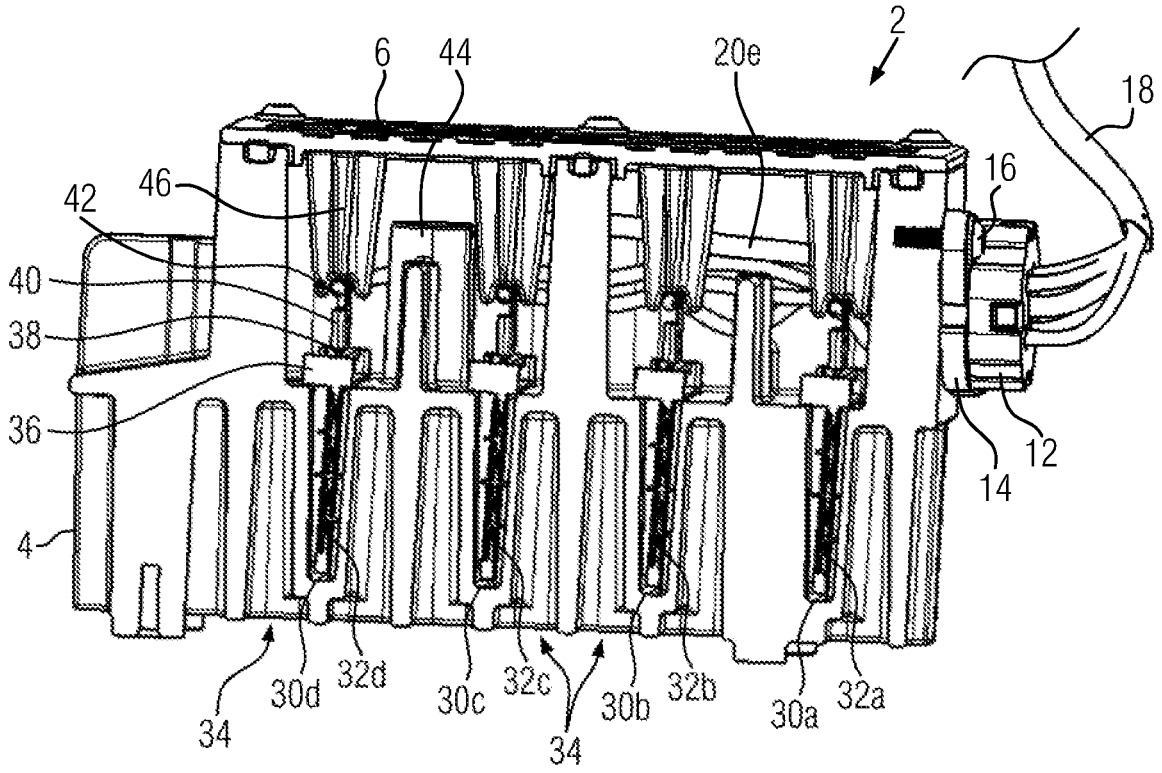
FIG. 2 shows a longitudinal section view of the electrical load resistance of the embodiment.

The sectional view shown in FIG. 2 illustrates the internal structure of the electrical load resistance 2. The housing 4 forms four U-shaped receiving pockets 30, in each of which a PTC heating element 32 is arranged. The PTC heating elements 32 in the receiving pockets 30 are in heat-conducting contact with the housing 4. The outer side of the receiving pockets 30 at least partially forms an outer wall of the housing 4. At least one indentation 34 of the housing is provided between two receiving pockets 30. The indentations 34 are also essentially U-shaped and aligned antiparallel to the receiving pockets 30. The receiving pockets 30 thus form cooling fins which are at least partially exposed on the outside of the housing 4 so that the housing 4 itself is configured as a heat sink.

Figure 5:
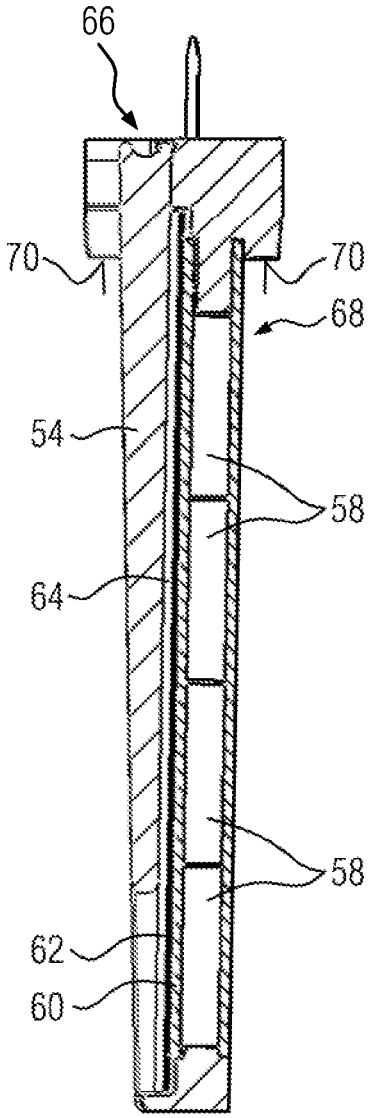
FIG. 5 shows a sectional view of a PTC heating unit of the embodiment.

A plastic frame 36 of the PTC heating units 32 protrudes from the receiving pockets 30, in which several PTC elements 58 and a contact plate 60, which is in electrically conductive contact with the PTC elements 58, are held (see FIG. 5). Furthermore, a terminal lug 38 of the contact plate protrudes from the receiving pocket 30. The terminal lug 38 is electrically connected to a plug element 40. Within the receiving pocket 30, the contact plate is usually electrically insulated from the housing by an insulating layer 62. On the side opposite the contact plate 60, the PTC elements 58 abut the housing 4 in an electrically conductive manner.

The plug element 40 has a crimp connection 42 with one of the strands 20 of the connecting cable 18 which are connected to the positive/ground terminal. Inside, the housing 4 forms a column-shaped ground terminal 44, which is electrically connected to a ground strand 20*e* of the connecting cable 18. The housing 4 thus forms a ground potential for the PTC heating elements 32 and is part of a circuit that is supplied by the 12V vehicle electrical system.

When the current is passed through the PTC heating elements 32, they heat up, which emit the heat to the housing 4 through heat-conducting abutment in the receiving pockets 30. The receiving pockets 30, designed as cooling fins, then radiate the heat to the surroundings. From the housing cover 6, webs 46 extend column-like into the interior of the housing 4. These webs 46 are made in one piece with the housing cover 6 and are made of plastic. The webs 46 extend in elongation of the receiving pockets 30, wherein the tip of the webs 46 pointing to the openings of the receiving pockets 30 has a U-shaped recess to which the crimp connection 42 abuts. By fixing the housing cover 6 to the housing 4 by means of the screws 8, the webs 46 exert a certain pressure on the plug elements 40 and thus also on the PTC heating elements 32 in the direction of the receiving pocket 30. This ensures that the plug contacts are secured and that the PTC heating elements 32 always abut the housing 4 in a thermally conductive manner in the receiving pockets 30. In addition, the webs 46 each form a form fit for the PTC heating elements 32 in the direction of the opening of the receiving pockets 30 so that it is prevented that the PTC heating elements 32 can lift out of the receiving pockets 30, for example, due to vibration, or that the plug element 40 comes loose from the terminal lug 38.

Figure 3:
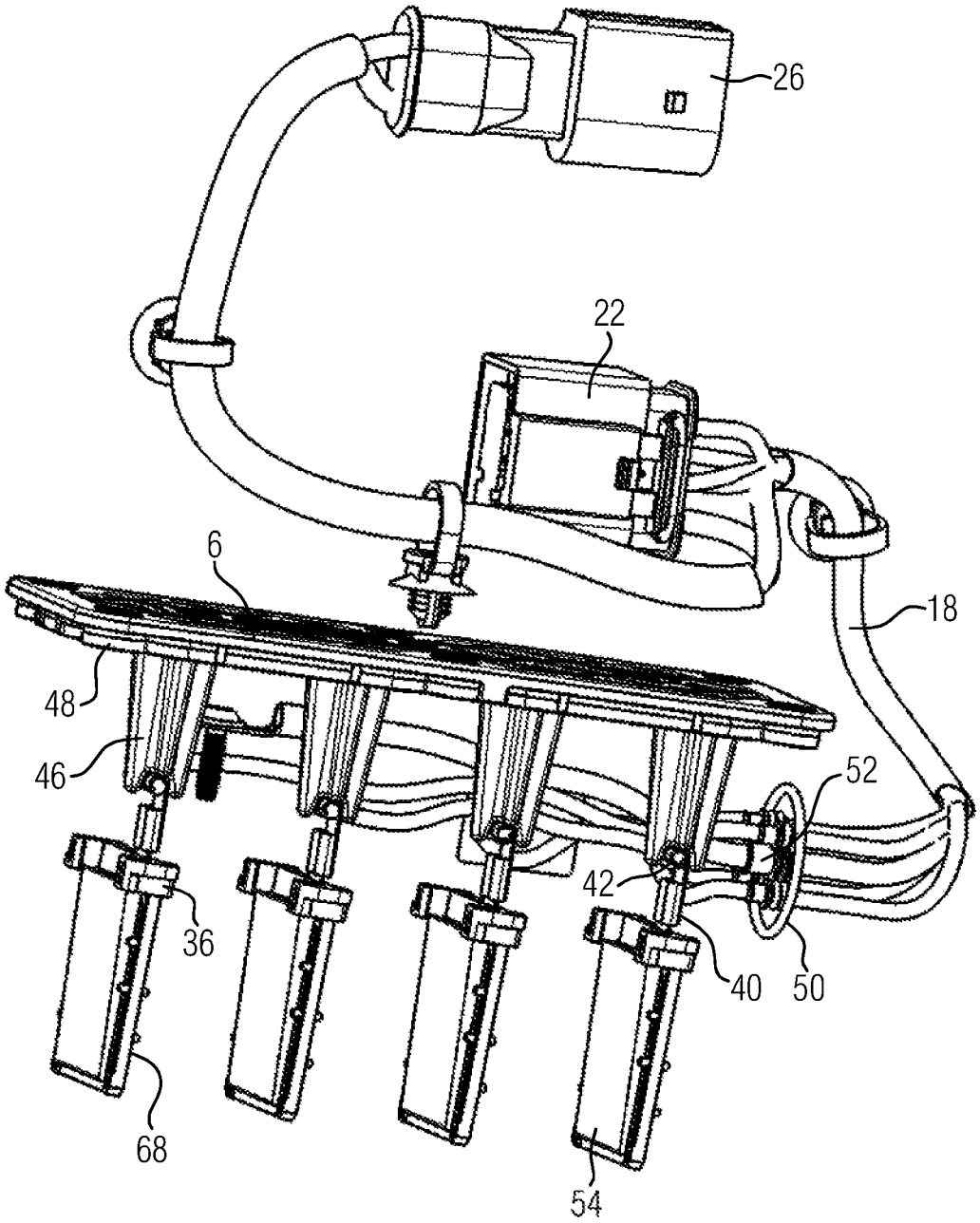
FIG. 3 shows a perspective side view of components of the embodiment.

FIG. 3 shows the components of the electrical load resistance excluding the housing 4. For example, FIG. 3 shows that the housing cover 6 is attached to the housing 4 by means of an intermediate layer of an insert seal 48. The sealing element 12, which is also not shown in FIG. 3, is also sealed against the housing 4 with the interposition of an O-ring 50 which forms the seal 14. The strands 20 of the connecting cable 18 have 10 single strand seals 52 at the height of the through-hole. The plastic frame 36 of the PTC heating units 32 holds a wedge element 54 which, in a manner known per se, ensures a thermally conductive abutment of the PTC heating unit 32 in the receiving pocket 30; cf. EP 1 872 986 A1.

Figure 4:
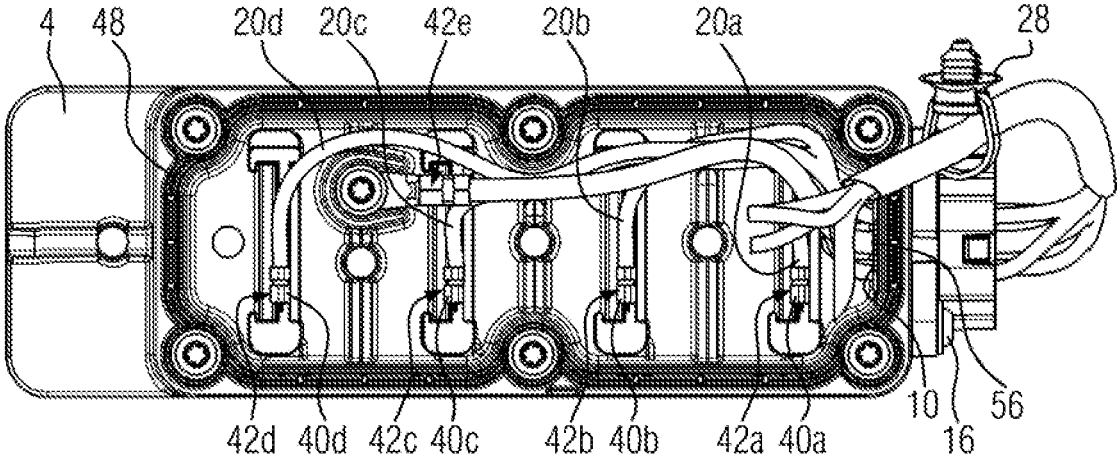
FIG. 4 shows a top view of the electrical load resistance of the embodiment with omitted housing cover.

As can be seen from FIG. 4, the individual strands 20 of the connecting cable 18 are each led through a channel 56 of the sealing element 12. In these channels 56, the single strand seals 52 are provided which are elastically pressed in radial direction by the channels. Thus, the through-hole 10 is closed in a fluid-tight manner by the sealing element 12 and the seal 14.

FIG. 5 shows the PTC heating unit 32 in detail. In the plastic frame 36 of the PTC heating unit 32, four PTC elements 58 are arranged one above the other in a row. On the left-hand side in FIG. 5, a contact plate 60 abuts the main side surfaces of the PTC elements 58 in an electrically conductive manner. The contact plate 60 forms the terminal lug 38, which protrudes over the plastic frame 36 and thus also the receiving pocket 30 and is exposed in the connection chamber The contact plate 60 is insulated from the housing 4 by means of an insulating layer 62 which lies on the outside of the contact plate 60. A sliding plate 64 is provided on the outside of the insulating layer 62, on the outside of which the wedge element 54 abuts. The wedge element 54 is shown in a holding position in which it is located in an insertion opening 66 of the plastic frame 36. When the wedge element 54 is fully inserted into the plastic frame 36, it causes a heat-conducting abutment between the PTC heating element 32 and the receiving pocket 30. On the side of the PTC elements 58 opposite the contact plate 60, an electrically conductive ground plate 68 abuts the main side surfaces of the PTC elements 58. On its outer side, the ground plate 68 abuts electrically and heat-conductively against an inner side of the receiving pocket 30. At the end protruding from the terminal lug 38, the plastic frame 36 forms a stop 70 which abuts the housing 4 around the opening to the receiving pocket 30.

The PTC elements 58 are held and positioned between the ground plate 68 and the wedge element 54 in the plastic frame 36. This allows the PTC heating element 32 to be prefabricated and handled as a unit.

We claim:

1. An electrical load resistance comprising:

a closed housing having at least one U-shaped receiving pocket in which at least one PTC heating element is accommodated, the PTC heating element comprising at least one PTC element and at least one contact plate that is electrically conductively connected to the PTC element for energizing the PTC element, wherein the contact plate has a terminal lug for plug contacting the PTC element, wherein the PTC heating element abuts at least on opposite main side surfaces of the receiving pocket in a heat-conducting manner, wherein the terminal lug projects above the receiving pocket, and wherein the closed housing is configured such that no medium can circulate through the closed housing.

2. The electrical load resistance according to claim 1, wherein outer surfaces of the housing form the only boundary surfaces of the electrical load resistance for dissipating heat.

3. The electrical load resistance according to claim 1, wherein the receiving pocket is exposed as a cooling fin on an outer side of the housing.

4. The electrical load resistance according to claim 3, wherein at least one indentation of an outer wall of the housing is provided between two cooling fins.

5. The electrical load resistance according to claim 1, further comprising a housing cover which has a web for secondary locking of the plug connection of the PTC element.

6. The electrical load resistance according to claim 1, further comprising a cable for connection to the PTC heating element, wherein the cable is led through the housing in a sealing manner.

7. The electrical load resistance according to claim 1, wherein the PTC element is electrically conductively connected to the housing, and wherein the housing forms a ground potential for the PTC element.

8. The electrical load resistance according to claim 1, wherein the housing is made of a material having a specific heat capacity of at least 800 J/(K·Kg) at a material temperature of 20° C., and wherein the housing has a weight of at least 500 g.

9. A device for reducing the starting time of an internal combustion engine, the device comprising:

an electrical load resistance with at least one PTC heating element accommodated in a housing, wherein the electrical load resistance is connected to a generator driven by the internal combustion engine, wherein the housing is mounted on a vehicle comprising the internal combustion engine such that heat generated by the device is exclusively and directly dissipated to the environment or stored in the housing, and wherein the housing is a closed housing that is configured such that no medium can circulate therein.

10. A method for reducing the starting time of an internal combustion engine, comprising:

measuring a temperature of the combustion engine;

operating a load resistance connected to a generator driven by the combustion engine until the measured temperature of the combustion engine reaches a predetermined temperature, wherein the load resistance comprises at least PTC heating element, and wherein the heat generated by the at least one PTC heating element is not transferred onto a guided medium flow.

11. The method according to claim 10, wherein the load resistance is operated cyclically, and wherein one cycle includes a power phase and a rest phase.

12. The method according to claim 11, wherein the one cycle lasts between 30 and 120s and/or wherein the rest phase is 2 to 5 times longer than the power phase.

13. The electrical load resistance according to claim 1, wherein the closed housing lacks any openings for the inlet or outlet of a medium.

14. The device according to claim 9, wherein the closed housing lacks any openings for the inlet or outlet of a medium.

* * * * *